US005318378A

United States Patent [19]

Lent

[11] Patent Number: 5,318,378

[45] Date of Patent: Jun. 7, 1994

[54] METHOD AND APPARATUS FOR CONTROLLING A COLD PLANER IN RESPONSE TO A KICKBACK EVENT

[75] Inventor: Kevin C. Lent, Rogers, Minn.

[73] Assignee: Caterpillar Paving Products Inc., Minneapolis, Minn.

[21] Appl. No.: 951,957

[22] Filed: Sep. 28, 1992

[51] Int. Cl.[5] ..... E01C 23/12

[52] U.S. Cl. ..... 404/75; 404/84.1; 404/90

[58] Field of Search ..... 404/84.05, 84.1, 90, 404/75

[56] References Cited

U.S. PATENT DOCUMENTS

| | | | |
|---|---|---|---|
| 4,186,968 | 2/1980 | Barton . | |
| 4,270,801 | 6/1981 | Swisher, Jr. et al. . | |
| 4,802,787 | 2/1989 | Bays | 404/90 |
| 4,929,121 | 5/1990 | Lent et al. . | |

FOREIGN PATENT DOCUMENTS

| | | | |
|---|---|---|---|
| 4143140 | 7/1992 | Fed. Rep. of Germany | 404/84.05 |
| 611992 | 6/1978 | U.S.S.R. | 404/84.05 |
| 885397 | 11/1981 | U.S.S.R. | 404/84.05 |
| 8847 | 5/1992 | World Int. Prop. O. | 404/84.1 |

*Primary Examiner*—Mark Rosenbaum
*Assistant Examiner*—Frances Chun
*Attorney, Agent, or Firm*—Robert A. McFall

[57] ABSTRACT

A sensor measuring support strut pressure on a cold planer provides a signal for controlling extension of the struts to maintain contact between the ground and the strut in the event of a kickback. Rotation of the planing cylinder is also interrupted in response to the signal, and resumption of vehicle operation is prevented until the support strut pressure is sufficient to enable the operator to control movement of the vehicle.

20 Claims, 2 Drawing Sheets

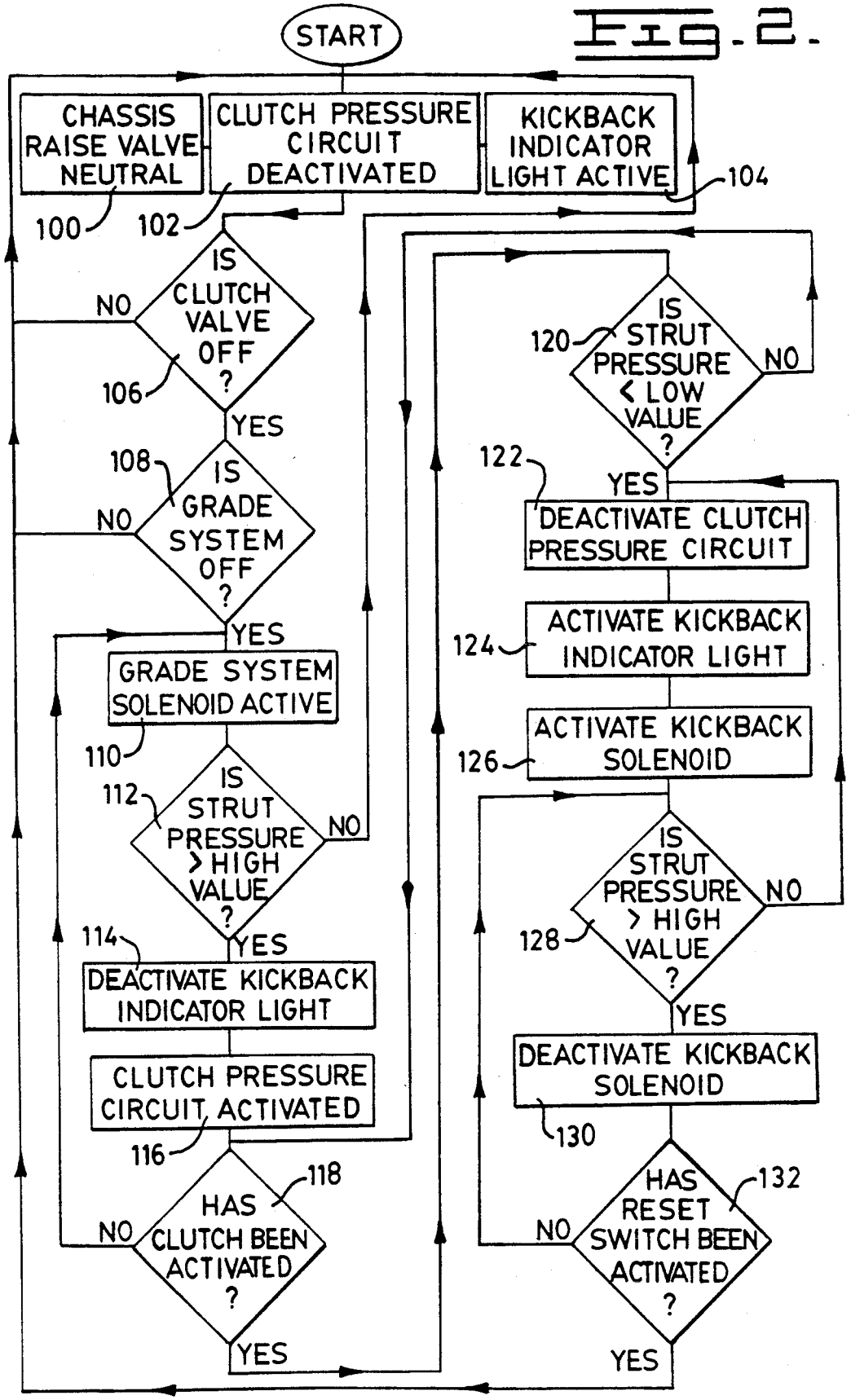
START
Fig. 2.
CHASSIS RAISE VALVE NEUTRAL
CLUTCH PRESSURE CIRCUIT DEACTIVATED
KICKBACK INDICATOR LIGHT ACTIVE
100
102
104
IS CLUTCH VALVE OFF ?
NO
YES
106
108
IS GRADE SYSTEM OFF ?
NO
YES
GRADE SYSTEM SOLENOID ACTIVE
110
112
IS STRUT PRESSURE > HIGH VALUE ?
NO
YES
114
DEACTIVATE KICKBACK INDICATOR LIGHT
CLUTCH PRESSURE CIRCUIT ACTIVATED
116
118
HAS CLUTCH BEEN ACTIVATED ?
NO
YES
120
IS STRUT PRESSURE < LOW VALUE ?
NO
YES
122
DEACTIVATE CLUTCH PRESSURE CIRCUIT
124
ACTIVATE KICKBACK INDICATOR LIGHT
126
ACTIVATE KICKBACK SOLENOID
128
IS STRUT PRESSURE > HIGH VALUE ?
NO
YES
DEACTIVATE KICKBACK SOLENOID
130
132
HAS RESET SWITCH BEEN ACTIVATED ?
NO
YES

METHOD AND APPARATUS FOR CONTROLLING A COLD PLANER IN RESPONSE TO A KICKBACK EVENT

TECHNICAL FIELD

This invention relates generally to an automatic control process and apparatus for controlling a roadway planer and more particularly to an automatic control process and apparatus for controlling a roadway planer in response to a occurrence of a kickback event during roadway milling operations.

BACKGROUND ART

Roadway planers, also known as pavement profilers, road milling machines or cold planers, are machines designed for scarifying, removing, mixing or reclaiming, material from the surface of bituminous or concrete roadways and similar surfaces. These machines typically have a plurality of tracks or wheels which support and horizontally transport the machine along the surface of the road to be planed, and have a rotatable planing cylinder that is vertically adjustable with respect to the road surface.

On cold planers that integrate the machine chassis with the planing cylinder, as described in U.S. Pat. No. 4,186,968, issued Feb. 5, 1980, to Robert M. Barton and currently assigned to the assignee of the present invention, the entire chassis is raised or lowered to control the depth of cut of the cutting bits into the ground surface. If the cutting bits strike a high density inclusion, such as a manhole cover or railroad track during the planing operation, an event known as a "kickback" can occur.

A kickback event sensor that senses fluid pressure in a hydraulic circuit regulating the height of an adjustable strut member on the cold planer is described in U.S. Pat. No. 4,929,121 issued May 29, 1990 to Kevin C. Lent et al. and assigned to the assignee of the present invention. The control system described in this reference employs a signal produced by a pressure switch, in response to a kickback event, to sequentially disengage the cutter, or planing cylinder, from the drive engine.

When a kickback event occurs, the planing cylinder on a typical down-cutting machine will attempt to rise up out of the cut. In a similar manner, changes in material density can cause the chassis on an up-cutting machine to also rise up out of the cut. If the cold planer is operating with an automatic grade control system, such as the portable string line system described in U.S. Pat. No. 4,270,801 issued Jun. 2, 1981 to George M. Swisher, Jr. et al, the automatic grade control, sensing that the machine is above the desired grade, will attempt to lower the chassis by retracting the supporting strut members, leaving the machine principally supported on the rotor. In this position, the machine cannot be steered or braked because of insufficient contact between the strut mounted tracks, or wheels, and the ground. In this condition, the operator may not be able to stop, steer, or control undesirable movement of the machine.

The present invention is directed to overcoming the problems set forth above. It is desirable to have a kickback event control arrangement that, in the event of a kickback, will maintain sufficient vehicle weight on the ground support members to permit the operator to maintain operational control of the movement of the machine. It is also desirable to have a method of controlling the operation of a cold planer so that sufficient weight is maintained on the ground support members to inhibit loss of operational control of the machine during the occurrence of a kickback event.

DISCLOSURE OF THE INVENTION

In accordance with one aspect of the present invention, a kickback control system for a cold planer having a vertically adjustable chassis supported by a plurality of extendable support members and a planing cylinder rotatably mounted on the chassis, includes a first means for sensing a force imposed, in a direction normal to a ground surface, by the chassis on at least one of the support members and delivering a data signal that is responsive to the value of the sensed force. The kickback control system also includes a second means for receiving the data signal and delivering a control signal if the value of the data signal is less than a predetermined value. Further, the kickback control system includes a third means for increasing the force imposed by the chassis on the extendable support members, and a fourth means for interrupting the rotation of the planing cylinder, in response to the control signal.

In another aspect of the present invention, a method for controlling a cold planer in response to a kickback event, in which the cold planer has a vertically adjustable chassis supported by a plurality of extendable support members and a planing cylinder rotatably mounted on the chassis, includes sensing a force imposed in a direction normal to a ground surface by the chassis on at least one of the support members and delivering a data signal that is responsive to the value of the sensed force. The value of the data signal is compared with a predetermined value, and if found to be less than the predetermined value, a control signal is delivered. In response to the control signal, the force imposed by the chassis on the support members is increased and rotation of the planing cylinder is interrupted.

BRIEF DESCRIPTION OF THE DRAWINGS

FIG. 2 is a flowchart illustrating the control logic for the method of controlling a cold planer embodying the present invention.

BEST MODE FOR CARRYING OUT THE INVENTION

Figure 1:
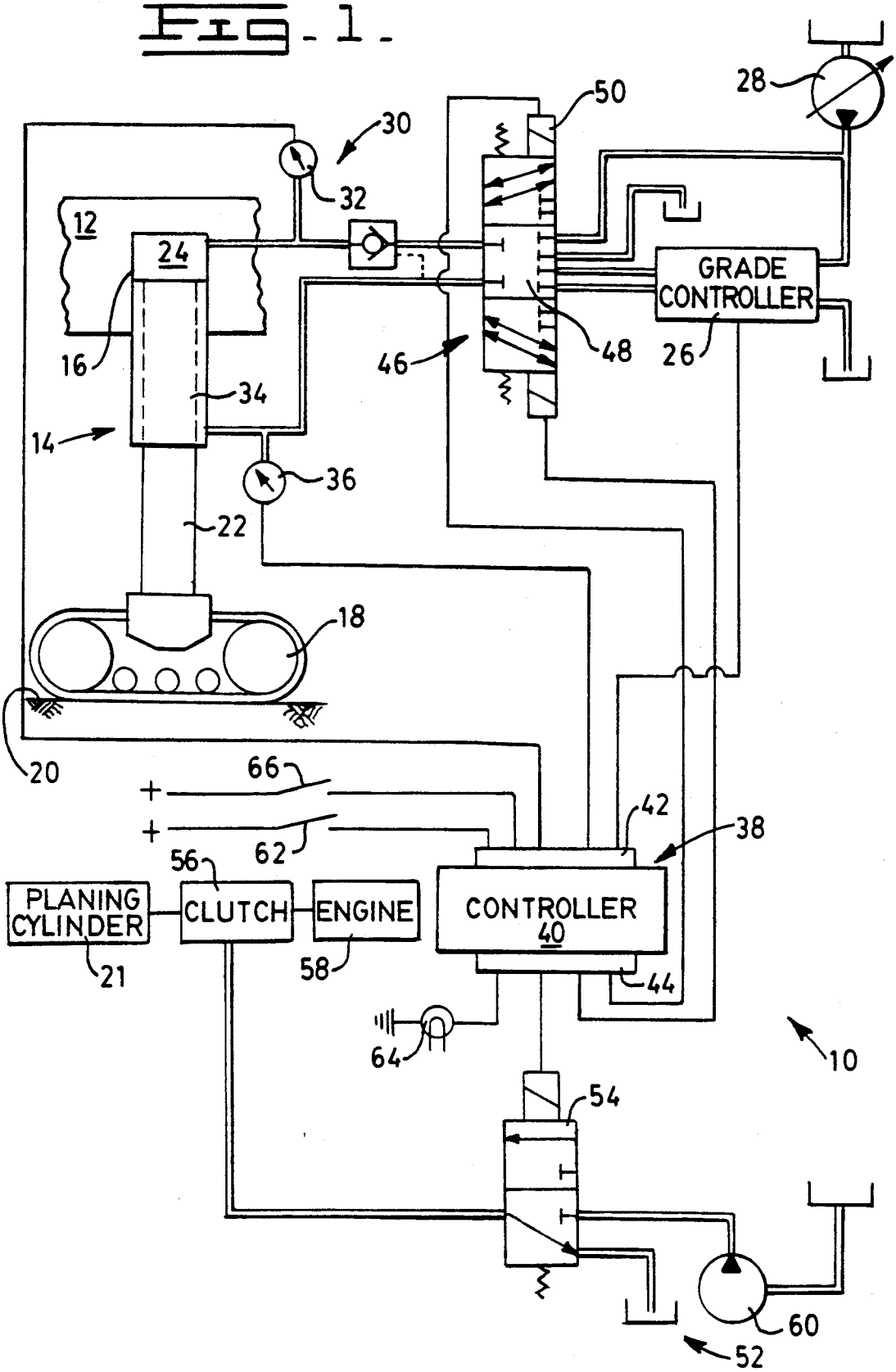
FIG. 1 is a schematic diagram showing elements of the kickback control system embodying the present invention.

A kickback control system 10 for a cold planer having a vertically adjustable chassis 12 supported by a plurality of extendable support members 14 each having a first end 16 connected to the chassis 12 and a second end 18 in contact with a ground surface 20 is shown schematically in FIG. 1. Cold planers, also known as roadway profilers or milling machines, are described in the aforementioned U.S. Pat. No. 4,186,968 and are well known in the art. Such machines typically have a rotor, or planing cylinder 21, rotatably mounted on the chassis at a position intermediate the forward and rearward ends of the chassis and disposed transversely with respect to the direction of travel of the cold planer. The planing cylinder has a plurality of cutting bits mounted thereon which engage the ground or pavement which is fragmented by the cutting action of the bits.

The depth of the cutting action is dependent upon the elevational position of the planing cylinder with respect to the supporting ground surface. Typically, the extendable support members 14 include hydraulically actuated strut assemblies 22 having at least one pressure chamber 24 that is connected, by way of a grade control system 26, to a source of pressurized hydraulic fluid which, as indicated in FIG. 1, is provided by a variable displacement pump 28.

The grade control system 26 typically includes a sensor to provide a grade reference for control of the position of the chassis 12 relative to the roadway 20. Such grade control systems for cold planers are well known, as for of example the string line based grade reference arrangement described in the above mentioned U.S. Pat. No. 4,270,801. Preferably, the operational mode of the grade controller 26 is governed by a dash-mounted switch that enables the machine operator to selectively place the grade controller in either an automatic or a manual operating mode. In the preferred embodiment of the present invention, the grade controller 26 includes a signal generator to provide a data signal indicative of the selected operating mode.

As illustrated in FIG. 1, the kickback control system 10 includes a first means 30 for sensing the force imposed in a direction normal to the ground surface 20 by the chassis 12 on at least one of the support members 14, and delivering a data signal responsive to the value of the sensed force. Preferably, the first means 30 comprises a pressure sensor 32, having an integrated sending unit, in fluid communication with the pressure chamber 24 of one of the strut assemblies 22, e.g. the pressure sensor 32 may be connected near the pressure chamber 24 to a hydraulic line communicating with the pressure chamber. As can be seen from the schematic representation, the chassis 12 is raised upwardly by increasing the volume of an essentially incompressible fluid, such as hydraulic fluid, in the upper chamber 24 and correspondingly decreasing the volume of fluid in a lower pressure chamber 34 of the strut 22. Conversely, the chassis 12 is lowered by decreasing the volume of fluid in the upper chamber 24 and increasing the volume of fluid in the lower chamber 34.

It may be desirable, if the grade control system 26 is arranged so that pressure is trapped in the lower pressure chamber 34, that the first means 30 also include a pressure sensor 36 in fluid communication with the lower pressure chamber 34. The pressure sensor 36 thus may provide an additional data signal indicative of the pressure in lower chamber 34.

Alternatively, the first means 30 may comprise a load cell or strain gage attached to the strut 22 to sense the compressive force, carried through the strut, that is imposed by the chassis 12 on the support member 14.

The kickback control system 10 also includes a second means 38 for receiving one or more data signals and delivering one or more control signals in response to the value of the data signals. Preferably the second means 38 comprises an electronic controller 40, such as a Motorola 6809 8-bit programmable microprocessor, and an analog to digital converter 42 for converting analog data signals to digital signals. The second means 38 also preferably includes a digital to analog converter 44 for converting the digital output signals of the microprocessor 40 to analog control signals. The logic sequence controlling the processing of incoming data signals and the output of control signals is shown in FIG. 2 and described below in more detail.

Alternatively, the second means 38 may comprise a programmable logic controller or may be incorporated as a subroutine in a comprehensive on-board computer that monitors and controls multiple vehicle systems.

The kickback control system 10 further includes a third means 46 for increasing the force imposed in a direction normal to the ground surface 20 by the chassis 12 on the support members 14. The third means 46 includes a first valve 48 that, as shown in FIG. 1, is preferably a three position, center biased, valve that is solenoid operated to shift the valve to either a first operative position represented by the lower block of the valve diagram, or a second operative position represented by the upper block. When the first valve 48 is shifted to the first operative position, the flow of pressurized hydraulic fluid from the variable displacement pump 28 is controlled by the grade control system 26 which selectively directs the pressurized fluid to either the upper pressure chamber 24 or the lower pressure chamber 34 of the strut assembly 22 to raise or lower the chassis 12, as required, to maintain a desired elevational position of the planing cylinder 21. The third means 46 also includes a kickback solenoid 50 which, when activated in response to a control signal for the controller 40, shifts the first valve 48 to the second operative position, providing a flow of pressurized fluid to the upper pressure chamber 24 directly from the pump 28.

As a result of pressurizing the upper chamber 24, the strut assembly 22 is controllably extended, as described below, so that the second end 18 of the support member 14 is maintained in contact with the ground and a predetermined minimum weight, or force, is imposed on the extendable support member 14. This action assures that sufficient force is provided on the strut assembly 14 to maintain weight bearing contact between the second end 18 of the support member and the ground surface 20. Thus, the strut is not only prevented from lifting off the ground surface 20 but also, during the occurrence of a kickback event, the operator is able to maintain control of machine movements such as braking and steering.

As an alternative embodiment, the first valve 48 may be incorporated into the grade control system 26 as an integral part thereof, so that when a kickback event is sensed the grade controller will direct a flow of pressurized fluid only to the upper chamber 24, and relieve the lower chamber 34, in response to a control signal from the electronic controller 40.

Alternatively, the extendable support members 14 may comprise linearly actuated struts such as a ball-screw actuator, in which embodiment the third means 46 may comprise either an electric or hydraulic motor to drive the actuator.

The kickback control system 10 also includes a fourth means 52 for interrupting the rotation of the planing cylinder 21. In the present embodiment the fourth means 52 includes a second valve 54 in fluid communication with a pressure actuated clutch 56 and a source of pressurized fluid such as a pump 60. The clutch 56, when pressurized, operatively couples the planing cylinder 21 to a drive engine 58. As shown in FIG. 1, the second valve 54 is a two position solenoid actuated valve that is spring biased to a normally open position to relieve fluid pressure from the clutch 56. When actuated by the solenoid, the second valve 54 is moved so that the portion of the valve represented by the upper block of the schematic representation is operable, and pressurized fluid is directed from the pump 60 to the clutch 56. Also, a data signal indicative of the position, either active or inactive/vented, of the second valve 54 in the clutch pressure circuit is provided to the electronic processor 40 which provides a control signal responsive to the active or inactive state of the fourth means 52.

Alternatively, the fourth means 52 may comprise multiple, sequentially actuated, components such as the belt tensioner, brake and clutch arrangement described in the aforementioned U.S. Pat. No. 4,929,121. Although shown as a hydraulic system in the present embodiment, the fourth means 52 may comprise a compressed air system, or a combination of hydraulic and air components.

Preferably, the control system 10 also includes a switch 62 that is controlled by the machine operator between selective on and off positions to respectively activate or deactivate the fourth means 52. A data signal is provided to the electronic controller indicative of the position of the switch, i.e., whether or not current or voltage is present at the closed terminal.

It is also desirable to have an indicator light 64 mounted on the vehicle operator's panel to alert the operator that a kickback event has been detected and that the subroutine controlling strut extension and planing cylinder rotation in response to the kickback event is active. Also, in the present embodiment, a momentary contact reset switch 66, spring biased to an open position, is provided on the operator's panel to enable the operator to selectively reinitiate the control system after detection of a kickback event, after execution of the appropriate control sequence, and after the operator determines that it is safe to resume normal operation of the vehicle.

The operational sequence controlling the receiving of data signals, computations and comparisons with preselected values, and delivery of output signals by the electronic processor 40 is shown in FIG. 2. At start-up the processor 40 first determines, as indicated in blocks 100, 102 and 104, that the chassis raise valve, i.e., the first valve 48 is in the default/centered position indicated in FIG. 1, that the second, or clutch pressure circuit, valve 54 is in the default/vented position, and that the kickback indicator light 64 is on.

The control sequence checks the data signal indicative of the position of the second, or clutch pressure, valve 54, as indicated at block 106, and does not continue if the switch 62 is closed. If open, i.e., the clutch circuit off, the operating mode data signal received from the grade control system 26 is checked, at block 108, to assure that the automatic grade control system is not active, i.e., it is in the manual-off control position.

For the sake of consistency with the claims, the data signal representative of the open or closed position of the switch 62 is referred to herein as the second data signal, and the data signal representative of the grade control operating mode is identified as the fourth data signal. Similarly, the control signals delivered by the electronic controller 40 in response to the values of the second and fourth data signals are respectively designated in the claims as the third and fourth control signals.

If either the clutch pressure valve 54 or the grade control system 26 is active, the control loop returns to the initial startup position and will not proceed further into the control sequence until both are inactivated. After determining that the clutch system control switch 62 is not closed, i.e., that the clutch 56 is disengaged, and that the grade control system 26 is not in the automatic control mode, the operator, upon determining that the machine is ready for milling operations, may activate the grade control system, as indicated at block 110, by moving the selector switch provided on the instrument panel to the "automatic" position.

It is extremely desirable that before engaging the clutch 56 and thereby initiating rotation of the planing cylinder 21, that it be determined that an excessive portion of the weight of the machine is not being carried by the planing cylinder. Therefore, an important feature of the present invention is provided by the operation indicated at block 112. A first data signal, representative of the pressure in the upper chamber 24 of at least one of the struts 22, is measured by the pressure sensor 32 and delivered to the microprocessor 40. The value of the measured pressure in the upper chamber 24 of a strut that has no pressure trapped in the lower chamber 34 will correspond directly to the force imposed by the chassis 12 on the support member 14, in a direction normal to the ground surface. If pressure is trapped in the lower chamber 34, then the pressure in the upper chamber 24 will be the sum of the trapped pressure in the lower chamber and the weight, or force, of the vehicle. Thus, in a system having a pressurized lower chamber 34, the force imposed by the chassis 12 on the support member 14 corresponds to the differential pressure, i.e., the upper chamber pressure minus the lower chamber pressure.

Therefore, as indicated at 112, the value of the first data signal representing the pressure in the upper chamber, or alternatively the difference between the first data signal and a third data signal representing the pressure in the lower pressure chamber, is compared with a predetermined high value, e.g. about 75% to 80% of the pressure required to support the weight of the vehicle. As used in the following description and the claims, the predetermined high value is identified as the "second predetermined value". The electronic controller 40 of the second means 38 is programmed to deliver a control signal, identified herein as a "second control signal", if the value of the first, or alternatively the first and third differential, data signal is greater than the predetermined second, or high, value. In an illustrative example, if at least 75% to 80% of the vehicle weight is not being carried by the support members 14, the electronic controller will not generate the second control signal, and the control sequence will return to the initial start position. The sequence will not continue until the chassis is raised and sufficient weight shifted from the planing cylinder 21 to the support members 14 so that the strut pressure is greater than the predetermined second, or high value, and the second control signal is delivered by the controller 40. This control function prevents start up of the planing cylinder with the cylinder buried in the ground with more than, in this example, about 20% to 25% of weight of the vehicle supported by the planing cylinder.

In response to delivery of the second control signal, i.e., the strut pressure being greater than the preselected high, or second, value, the kickback indicator light is deactivated, block 114, and the clutch pressure circuit, at block 116, is activated, i.e., the second valve 54 is shifted to the position indicated by the upper block. At this point in the operational sequence, the machine is in an operable mode, with the operator having control of the clutch and grade control systems. Rotation of the planing cylinder 21 is initiated by closing the switch 62. Upon activation of the clutch 56 the kickback control sequence continues, as indicated at block 118.

During the milling operation, pressure in the upper chamber 24, or alternatively the differential pressure between the upper and lower chambers 24, 34, is continuously compared, at block 120 to determine if the pressure is above a preselected first, or low, value. As long as the strut pressure remains greater than the predetermined low value, e.g. from 0% to about 10% of the weight of the chassis, the control sequence follows the subroutine loop represented by blocks 118 and 120.

If a kickback event should occur at some time during the vehicle cutting operation, the machine will attempt to rise up out of the cut. As described above, the grade control system 26, sensing that the chassis is too high, will attempt to lower the chassis by retracting the extendable support members 14. This results in a dramatic drop in pressure in the upper chamber 24 of the strut 22. By way of illustration, if the upper chamber pressure, or in the alternative system the differential pressure, drops below the predetermined first, or low value, i.e., less than 0% to 10% of the chassis weight, the electronic processor 40 delivers a first control signal to deactivate the clutch pressure circuit 52, activate the kickback indicator light 64, and activate the kickback solenoid 50 on the first valve 48, as indicated at blocks 122, 124, and 126. More specifically, in response to the first control signal, the second valve 54 is shifted to the biased position in which fluid pressure to the clutch is relieved, the kickback event indicator light is activated alerting the operator that a kickback event has occurred and that the control system is overriding normal machine operation. Additionally, the first valve 48 is shifted to the position indicated by the upper block of the valve schematic diagram in FIG. 1. As a result these actions, rotation of the planing cylinder is interrupted, the lower pressure chamber 34 of the strut 22 is vented, and a supply of pressurized fluid is immediately directed to the upper pressure chamber 24.

The control routine continues in the subroutine indicated by blocks 122, 124 and 126 until, as indicated by block 128, the strut pressure, or differential pressure as the case may be, increases to a value greater than the aforementioned high, or second, value, e.g., about 75% to 80% of the pressure required to support the weight of the vehicle and, most importantly, the operator is able to maintain control of vehicle steering, braking, and traction.

When the strut pressure increases to a value greater than the predetermined second, or high, value, the kickback solenoid 50 is deactivated, at block 130, releasing the first valve 48 to its normal, center biased, inactive position. The control sequence continues in a subroutine indicated by blocks 128 and 130, continuously monitoring strut pressure, until the operator has determined that the problem precipitating the kickback event has been corrected, and that the machine is ready to continue normal operation. Upon activation of the reset switch 66, represented by block 132, the control routine is directed to the initial startup sequence.

Depending on the dynamic weight distribution, center of gravity, and up-cutting or down-cutting direction of the planing cylinder, it may be desirable to sense the pressure in one or more of the front struts, one or more of the rear struts, or a combination extending to possibly all of the struts. For example, in a down-cutting machine having a center of gravity substantially directly above the center of rotation of the planing cylinder, the rear struts will tend to rise in the event of a kickback. On a similar up-cutting machine, the front struts may tend to rise first. Also, it may be desirable to monitor the pressure in multiple struts and initiate the kickback control system in response to either a low pressure sensed in one of the struts, or an averaged low pressure sensed in more than strut.

Industrial Applicability

The kickback control system 10 embodying the present invention advantageously permits an operator to maintain, or very quickly regain, operational control of a cold planer when a kickback event is experienced. Furthermore, certain safeguards, such as prevention of planing cylinder rotation when excessive downward force is imposed on the cylinder, are provided in the subject kickback control system.

The elements comprising the kickback control system 10 the control logic routines defining the present invention may be combined with other existing control arrangements, or incorporated in comprehensive integrated control systems governing multiple vehicle functions such as propel and braking systems. For example, the present invention may be incorporated with present cutter and vehicle propulsion control and/or braking systems. In such combined systems, the present invention desirably increases strut pressure when a kickback event is sensed to provide the operator with improved control of vehicle motion.

Other aspects, objects and advantages of this invention can be obtained from a study of the drawing, the disclosure, and the appended claims.

I claim:

1. In a cold planar having a kickback control system, the planer having a vertically adjustable chassis supported by a plurality of extendable support members each having a first end connected to said chassis and a second end in contact with a ground surface and a planing cylinder rotatably mounted on said chassis, the improvement comprising said kickback control system including:

first means for sensing a force imposed in a direction normal to said ground surface by said chassis on at least one of said support members and delivering a first data signal responsive to the value of said sensed force, said first data signal having a range of values including predetermined first and second values within said range of values;

second means for receiving said first data signal and delivering a first control signal in response to the value of said first data signal being less than a predetermined first value;

third means for increasing said force imposed by said chassis on said plurality of extendable support members in response to said first control signal; and fourth means for interrupting the rotation of said planing cylinder in response to said first control signal.

2. A kickback control signal, as set forth in claim 1, wherein said second means includes means for delivering a second control signal in response to the value of said first data signal being greater than said predetermined second value, said predetermined second value being greater than said predetermined first value.

3. A kickback control system, as set forth in claim 1, wherein each of said extendable support members comprises a hydraulically actuated strut assembly having a pressure chamber and said third means includes a first valve interposed a source of pressurized hydraulic fluid and said pressure chambers, said first valve directing a flow of pressurized hydraulic fluid from said source to said pressure chambers in response to said first control signal.

4. A kickback control system, as set forth in claim 1, wherein said fourth means includes a second valve in fluid communication with a fluid pressure actuated clutch and a source of pressurized fluid, said clutch operatively coupling said planing cylinder to a drive engine, and said second valve relieving fluid pressure and uncoupling said planing cylinder from said drive engine in response to said first control signal.

5. A kickback control system, as set forth in claim 1, wherein said control system includes a switch connecting said fourth means to a source of electrical power, and said fourth means includes means for delivering a second data signal responsive to an electrically operative state of said fourth means, and said second means includes means for receiving said second data signal and delivering a third control signal responsive to the value of said second data signal.

6. A kickback control system, as set forth in claim 1, wherein each of said extendable support members comprises a hydraulically actuated strut assembly having a pressure chamber, and said first means includes a pressure sensor in fluid communication with the pressure chamber of at least one of said strut assemblies.

7. A kickback control system, as set forth in claim 1, wherein each of said extendable support members comprises a hydraulically actuated strut assembly having an upper pressure chamber and a lower pressure chamber, and said first means includes:

a first pressure sensor in fluid communication with the upper pressure chamber of at least one of said strut assemblies, said first data signal being responsive to the value of the sensed pressure in said upper pressure chamber;

a second pressure sensor in fluid communication with the lower pressure chamber of said same at least one of said strut assemblies; and, means for delivering a third data signal responsive to the value of the sensed pressure in said lower pressure chamber.

8. A kickback control system, as set forth in claim 7, wherein said second means includes means for receiving said first and third data signals, comparing said first and third data signals and determining a differential value, said first control signal being responsive to said differential value being less than said first predetermined value, and delivering a second control signal in response to said differential value being greater than a second predetermined value, said second predetermined value being greater than said first predetermined value.

9. A kickback control system, as set forth in claim 1, wherein said first means includes a load cell attached to at least one of said extendable support members.

10. A kickback control system, as set forth in claim 1, wherein said cold planer includes a grade controller for maintaining said planing cylinder in a selected elevational position with respect to said ground surface, said grade controller having means for delivering a fourth data signal responsive to the operational mode of said grade controller, and said second means includes means for receiving said fourth data signal and delivering a fourth control signal in response to the value of said fourth data signal.

11. A method for controlling a cold planer in response to a kickback event, said cold planer having a vertically adjustable chassis supported by a plurality of extendable support members each having a first end connected to said chassis and a second end in contact with a ground surface and a planing cylinder rotatably mounted on said chassis, said method comprising:

sensing a force imposed in a direction normal to said ground surface by said chassis on at least one of said support members;

delivering a first data signal responsive to the value of said sensed force;

comparing the value of said first data signal with a predetermined first value;

delivering a first control signal in response to the value of said first data signal being less than a predetermined value;

increasing said force imposed by said chassis on said plurality of extendable support members in response to said first control signal; and interrupting the rotation of said planing cylinder in response to said first control signal.

12. A method for controlling a cold planer in response to a kickback event, set forth in claim 11, wherein said method includes delivering a second control signal in response to the value of said first data signal being greater than a predetermined second value, said predetermined second value being greater than said predetermined first value.

13. A method for controlling a cold planer in response to a kickback event, as set forth in claim 11, wherein each of said extendable support members comprises a hydraulically actuated strut having a pressure chamber in fluid communication with a first valve interposed a source of pressurized fluid and said pressure chambers, and said step of increasing the force imposed by said chassis on said plurality of extendable support members includes directing a flow of pressurized fluid from said source to said pressure chambers in response to said first control signal.

14. A method for controlling a cold planer in response to a kickback event, as set forth in claim 11, wherein said cold planer includes a fluid pressure actuated clutch operatively coupling said planing cylinder to a drive engine, and a second valve in fluid communication with said clutch, and said step of interrupting the rotation of said planing cylinder includes moving said second valve to a position sufficient to relieve the fluid pressure actuating said clutch and uncoupling said planing cylinder from said drive engine in response to said first control signal.

15. A method for controlling a cold planer in response to a kickback event, as set forth in claim 11, including delivering a second data signal responsive to the operative position of said second valve, and delivering a third control signal responsive to the value of said second data signal.

16. A method for controlling a cold planer in response to a kickback event, as set forth in claim 11, wherein each of said extendable support members comprises a hydraulically actuated strut assembly having a pressure chamber and said step of sensing a force imposed in a direction normal to said ground surface by said chassis includes sensing the pressure of a fluid in communication with the pressure chamber on at least one of said support members.

17. A method for controlling a cold planer in response to a kickback event, as set forth in claim 11, wherein each of said extendable support members comprises a hydraulically actuated strut assembly having an upper pressure chamber and a lower pressure chamber, and said step of sensing the force imposed in a direction normal to said ground surface by said chassis includes separately sensing the pressure of a fluid in communication with said upper pressure chamber and a fluid in communication with said lower pressure chambers of at least one of said support members, and said step of delivering a first data signal includes delivering the first data signal in response to the value of the pressure of the fluid in communication with said upper pressure chamber, and delivering a third data signal responsive to the value of the pressure of the fluid in communication with said lower pressure chamber.

18. A method for controlling a cold planer in response to a kickback event, as set forth in claim 17, where said method includes the steps of comparing said first and third data signals and determining a differential value, delivering said first control signal in response to said differential value being less than the first predetermined value, and delivering a second control signal in response to said differential value being greater than a second predetermined value, said second predetermined value being greater than said first predetermined value.

19. A method for controlling a cold plane- in response to a kickback event, as set forth in claim 11, wherein said cold planer includes a load cell attached to at least one of the extendable support members, and said step of sensing a force imposed in a direction normal to said ground surface includes sensing the value of the force measured by said load cell.

20. A method for controlling a cold planer in response to a kickback event, as set forth in claim 11, wherein said cold planer includes a grade controller for maintaining said planing cylinder in a selected elevational position with respect to said ground surface and a means for delivering a fourth data signal responsive to the operational mode of said grade controller, said method including delivering a fourth control signal responsive to the value of said fourth data signal.

* * * * *